United States Patent [19]

Schenker et al.

[11] 4,186,790

[45] Feb. 5, 1980

[54] ACCESS SHIELD FOR UNCOVERED REFRIGERATED UNITS

[76] Inventors: M. Allan Schenker, 17046 Burbank Blvd. #16, Encino, Calif. 91316; Irving J. Kerstein, P.O. Box 404, Calabasas, Calif. 91302

[21] Appl. No.: 839,731

[22] Filed: Oct. 3, 1977

[51] Int. Cl.[2] ..... E06B 3/80; E06B 9/14

[52] U.S. Cl. ..... 160/329; 160/179; 312/116; 312/138 R; 312/297

[58] Field of Search ..... 160/179, 332, 327, 328, 160/329, 120, 166 A, 172, 176, 184; 312/116, 122, 138 R, 297; 62/246

[56] References Cited

U.S. PATENT DOCUMENTS

| | | | |
|---|---|---|---|
| 2,041,258 | 5/1936 | Mitchell | 160/184 |
| 2,370,794 | 3/1945 | Houmere | 160/168 |
| 2,748,854 | 6/1956 | Lynch | 160/179 |
| 2,793,925 | 5/1957 | Rosen | 62/246 |
| 3,028,910 | 4/1962 | Bopp et al. | 160/177 |
| 3,241,899 | 3/1966 | Donker | 312/297 |
| 3,298,425 | 1/1967 | Cayton et al. | 160/176 |

*Primary Examiner*—Peter M. Caun
*Attorney, Agent, or Firm*—Spensley, Horn and Lubitz

[57] ABSTRACT

Energy losses from market refrigerated display cases, which are normally open, can be dramatically reduced by use of an access shield according to the present invention. The access shield comprises a plurality of transparent and resilient panels, each panel being adjacent to at least one other and having an overlapping relationship with the adjacent panel. The panels may be mounted in a rigid frame and allow access therethrough by stretching and bending of one or more of the panels along the overlapped line. The plurality of panels may also be fitted to a spring tensioned roller and stretched across the aperture of the display refrigeration case. In another embodiment, the plurality of panels may each be attached at an opposite ends to a holder having a bow tie shaped protrusion which is urged into a receiving indentation a fixture to temporarily lock the panel in a predetermined position and yet to permit free rotation within a sector to facilitate access.

9 Claims, 10 Drawing Figures

FIG. 5
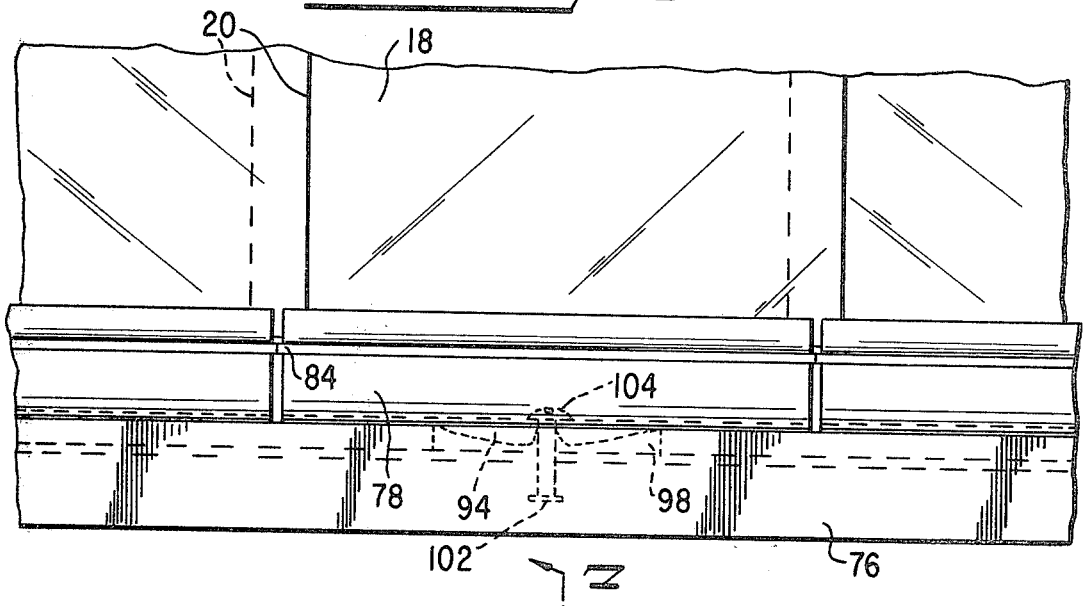
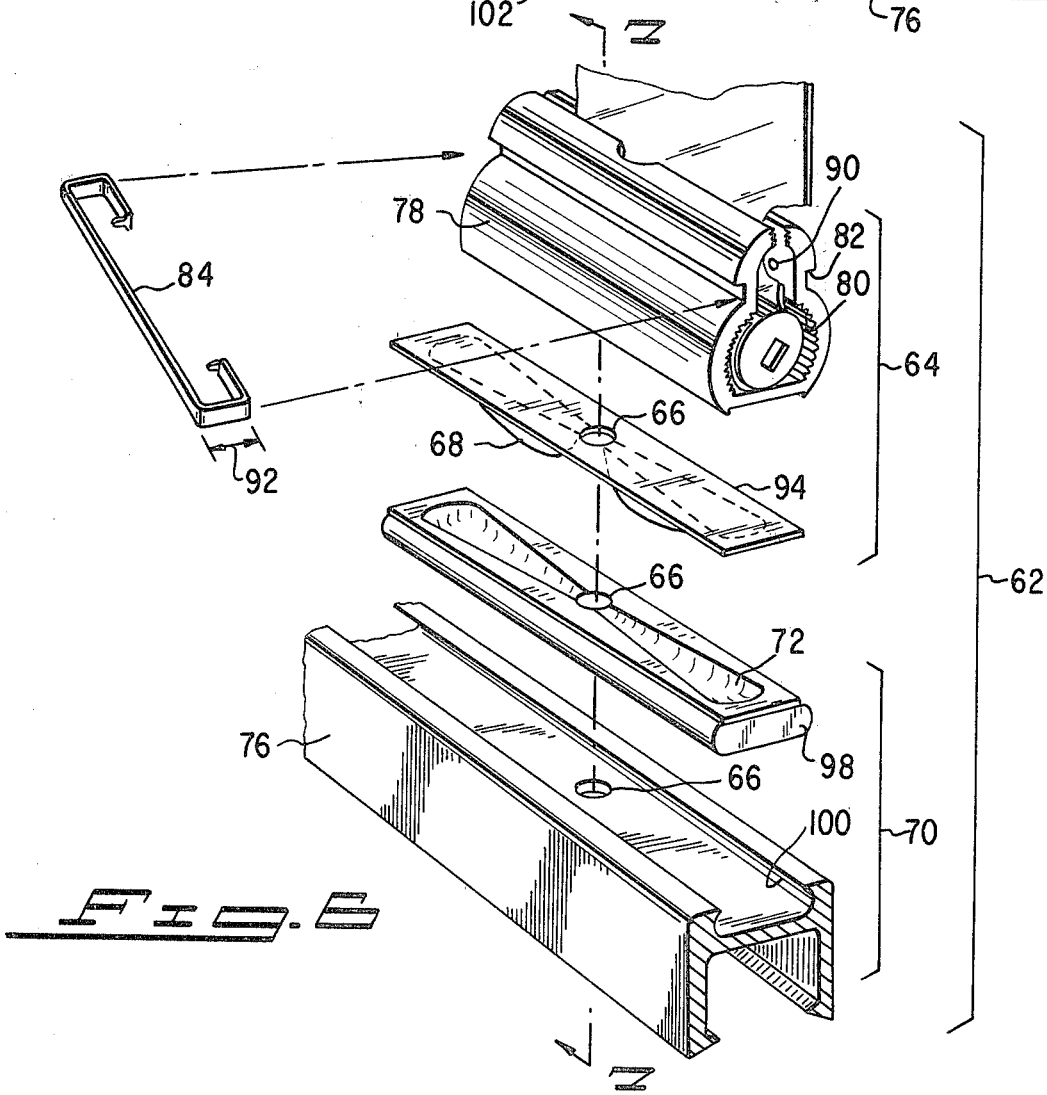
FIG. 6

ACCESS SHIELD FOR UNCOVERED REFRIGERATED UNITS

BACKGROUND OF THE INVENTION

1. Field of the Invention

The present invention relates to the field of refrigerated apparatus and in particular to means for temporarily opening and closing access apertures to refrigerated devices.

2. Description of the Prior Art

Refrigerated display apparatus in markets have typically used open refrigerated units both having horizontal openings and generally vertical openings. In those cases where the refrigerated unit has been provided with a barrier over the access opening, typically swinging or sliding glass doors have been provided.

The use of plastic or glass doors over refrigerated display openings has been limited due to the inconvenience of use, the high expense of installation, and high maintenance cost where such glass or plastic is subject to breakage, scratching, or discoloration. In many applications, such glass and plastic doors have provided only limited access to a portion of the refrigerated display unit or are cumbersome to open and remove merchandise from the refrigerated case in as much as such units typically incorporate a means for urging the heavy door back into the closed position.

What is needed is an access barrier for use with refrigerated display units which is simple, rugged, economical, and which provides substantially free access into and out of the refrigerated unit while effectively isolating the interior of the refrigerated unit from the ambient environment.

BRIEF SUMMARY OF THE INVENTION

The present invention is an apparatus for forming a shield across an aperture across which a temperature gradient is maintained while still permitting substantially free access therethrough. The apparatus comprises a plurality of substantially transparent panels and a means for disposing the plurality of panels across the aperture and tensioning the plurality of panels. Each one of the plurality of panels is adjacent to at least one other one of the plurality of panels. By reason of this combination, a thermal barrier is formed across the aperture without substantially prohibiting free movement therethrough.

The invention may further be characterized by the embodiment wherein each one of the plurality of panels assumes an abutting or overlapping relationship with at least one other one of the plurality of panels in at least one configuration. In another embodiment, each one of the plurality of panels may be resilient to facilitate access therethrough.

The means for disposing the plurality of panels across the aperture and tensioning the plurality of panels may include a frame rigidly holding the opposing edge segments of each one of the plurality panels. In another embodiment this means may include a spring means for maintaining tension on the plurality of panels. In yet another embodiment this means may include a rotating means for permitting rotation for at least one edge segment of each one of the plurality of panels.

The present invention and its various embodiments as set forth briefly and generally above can be better understood in connection with the following figures in light the detailed description of the preferred embodiments.

DESCRIPTION OF THE DRAWINGS

FIG. 5 is yet another embodiment of the present invention showing a fragmented plan view of a means for attaching each of the panels into a louvered array;

FIG. 6 is an exploded perspective view showing one embodiment of the device which may be used to rotatably attach the panels to a track as shown in FIG. 5;

DETAILED OF THE PREFERRED EMBODIMENT

The present invention is an access shield for thermally isolating an aperture in a refrigerated device from the ambient environment while permitting access through the aperture. The access shield comprises a plurality of resilient, substantially transparent panels. The plurality of panels have at least one configuration wherein each one of the panels is adjacent to and partially overlaps at least one other one of the panels. The apparatus further comprises a means for disposing a plurality of panels across the aperture and tensioning each one of the panels across the aperture. By reason of this combination of elements thermal energy flow across the aperture is reduced without prohibiting access across the aperture. The plurality of panels may also include at least one opening and typically a plurality of openings through the plurality of panels to permit a predetermined airflow through the opening and the panel array when in the normally closed configuration.

The utility, and the manner in which the present invention may be fabricated and used, can be better understood by considering the following description in conjunction with the Figures.

Figure 1:
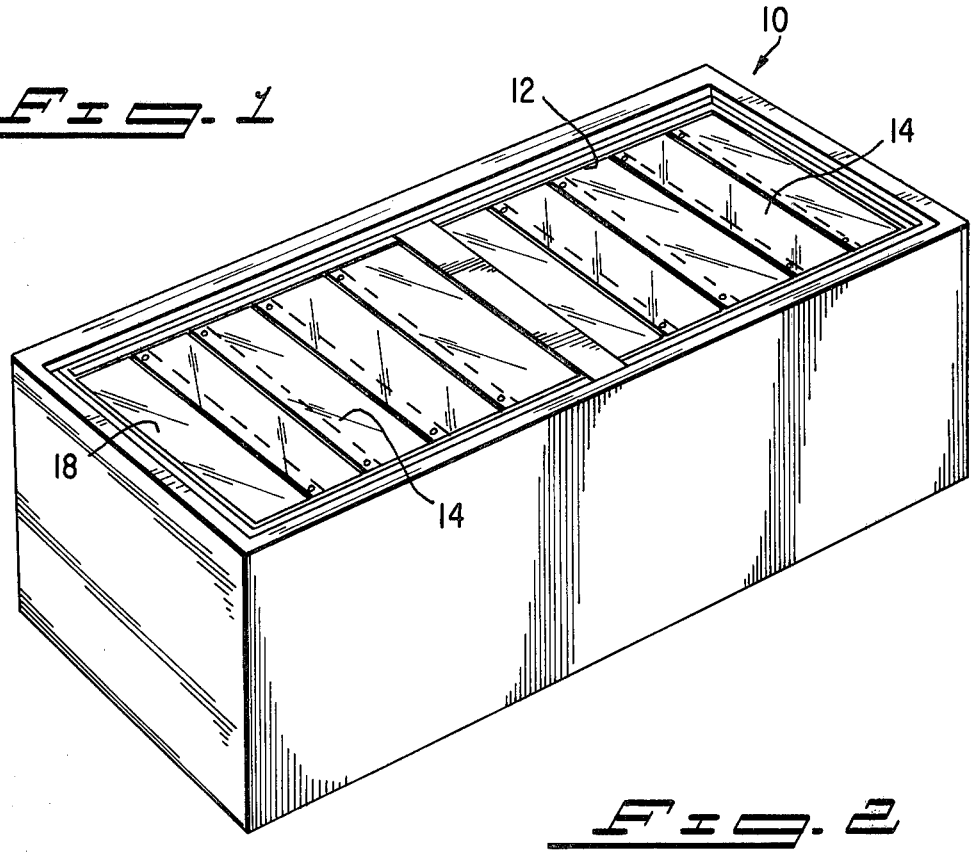
FIG. 1 is a perspective view showing one embodiment of the invention applied to a horizontal refrigeration display case.

In FIG. 1, a typical refrigerated display device 10 is shown as having its upper, horizontal aperture 12 covered by an array 14 of panels fabricated according to the present invention. Typically, the panels are substantially transparent, such as a transparent plastic, thereby permitting the consumer to freely view the contents through refrigeration display device 10. Array 14 of panels substantially close aperture 12 thereby reducing the amount of thermal energy lost across aperture 12 to the ambient environment. When the consumer desires to make a selection and remove an article from the interior of refrigerated display device 10 he merely thrusts his hand through array 14 and grasps the under-lying article. The panels of array 14 will yield or give way and permit both the consumer's hands to be thrust inward to the interior of refrigerated display device 10 and to permit the withdrawal of even bulky articles, such as frozen turkeys, without substantial interference. The embodiment of the present invention particularly shown in FIG. 1 is better seen in plan view in FIG. 2.

Figure 2:
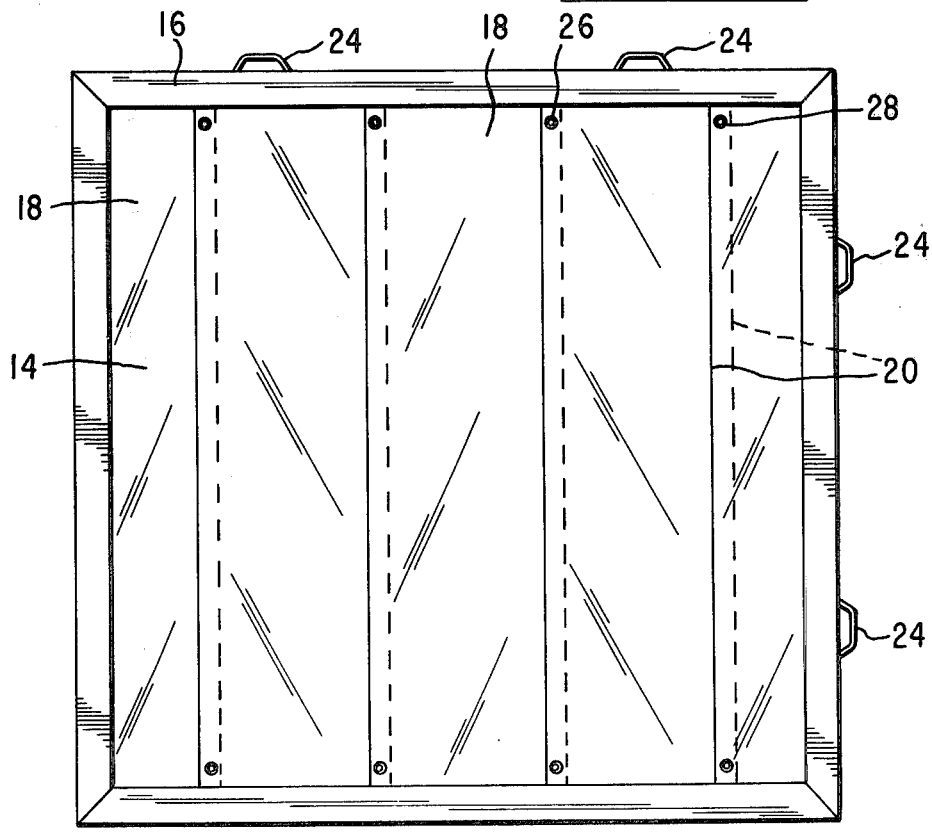
FIG. 2 is a plan view of the embodiment illustrated in FIG. 1.

FIG. 2 illustrates one embodiment of a means for disposing the plurality of panels across aperture 12 of refrigerated display device 10 and tensioning the plurality of panels. As shown in FIG. 2 this means includes a frame 16 which may be generally rectangular and typically made from extruded or rolled form aluminum, plastic or other compositions. Within frame 16 is a plurality of panels 18. In the embodiment illustrated, panels 18 are shown as having a generally rectangular shape, with a long or major axis many times greater than the shorter or minor axis. Throughout the specification the panels are shown as rectangular panels with straight edges. However, it must be understood that the panels may assume any geometric shape well known to the art including parallelograms, triangles, circles and even irregular shapes. Edges 20 of panels 18 need not be straight lines but may be curved, serrated, jagged, feathered or any configuration known to the art.

Frame 16 is coupled to opposing edge segments 22 of each one of the plurality of panels 18. Frame 16 may also include resilient springs 24 on at least two adjacent edges of frame 16. Frame 16 will typically be mounted in a perimeter mating J-channel track which is coupled to refrigerated display device 10. Springs 24 will be compressed within the J-channel perimeter and to adjacent H-channel multi-track, thereby securing frame 16 across aperture 12 in a manner well known to the art.

As shown in FIG. 2, panels 18 are disposed within frame 16 in an overlapping relationship. Each panel overlaps the next adjacent panel along at least a portion of the length of panel 18. Typically, the panel is made of a plastic material which has an inherent resiliency. When the consumer places his hand through the plane defined by panels 18, the panels will twist, stretch and deflect to permit the hand to move through substantially any point of array 14 of panels 18. Similarly, when the user withdraws his hand the natural resiliency of panels 18 will tend to bring the panels back into a substantially flat, sealing and/or overlapping relationship as shown in FIG. 2. Thus, array 14 of panels 18 form a thermal barrier which tends to maintain the temperature gradient across aperature 12 of refrigeration display device 10, and yet permits user access to the interior of refrigerated display device 10.

Figure 3:
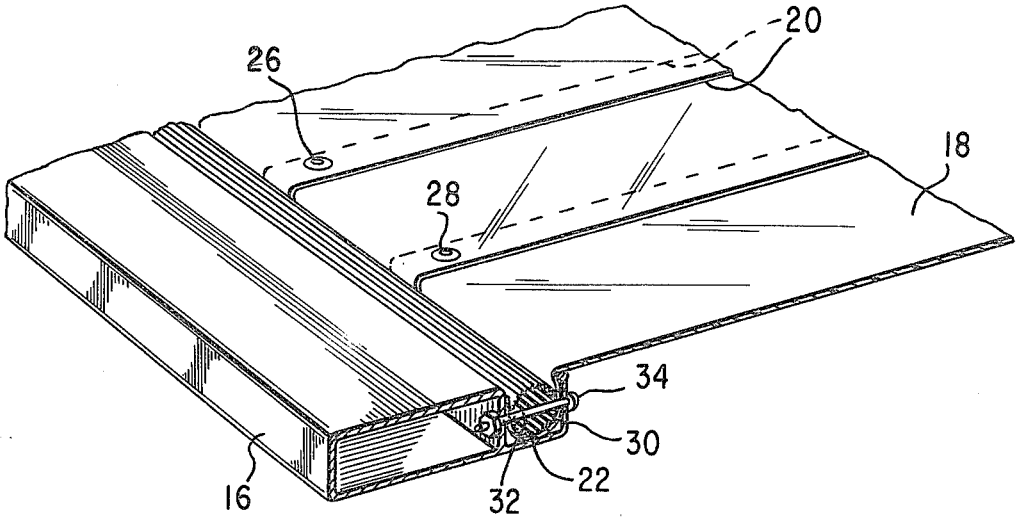
FIG. 3 is a section perspective view showing details of the edge of the plurality of panels and its attachment to the frame of FIG. 2.

As shown in FIG. 1 and as shown in greater clarity in FIG. 3, array 14 of panels 18 include a plurality of openings 26. In the embodiment illustrated in FIGS. 2 and 3, openings 26 are shown as disposed at the overlap between edges 20 on adjacent panels 18. Metal grommets 28 are fitted through the overlapping portion of both panels 18 and define opening 26. The size and number of grommets 28 are selected according to design principles well understood in the art to allow a predetermined amount of airflow through array 14 of panels 18, and to maintain positive, lateral tension between overlapping adjacent panels. Grommets 28 will permit airflow to prevent condensation which might otherwise be established because of the temperature gradient across array 14. Further, a limited amount of air circulation might be necessary in a refrigerated cabinet to avoid the accumulation of undesired odors or staleness. In the illustrated embodiment, grommets 28 are shown as disposed near edge segments 22 and thereby are substantially non-interfering with the separation of panels 18 along edges 20. Grommets 28 thus, also serve to aid as a mechanical fastener between adjacent panels 18. It is to be understood, however, that openings 26 may be disposed in array 14 in any manner desired according to well known design principles and that grommets 28 may be eliminated and a wide number of equivalent types of fasteners substituted.

FIG. 3 shows one way in which panels 18 may be fastened to frame 16. End segments 22 are disposed in a U-shaped channel 30 which may be formed as an integral part of an extruded aluminum frame 16. A resilient cord 32 having longitudinally ribbed serrations is press-fit into U-channel 30 over end segments 22 in a manner well known to the art. Cord 32 is well known in the screening industry and its dimensions, composition and design may be appropriately selected to optimize performance in the application in the present invention in view of the physical properties of panels 18 and the temperatures at which frame 16 will be maintained. Cord 32 may be secured to frame 16 by insertion of rivet 34 through selected ones of end segments 22, cord 32 and U-channel 30. Cord 32 may be temporarily secured by substituting screws or other temporary fasteners in place of rivet 34. The means used to fasten end segments 22 to frame 16 is shown by way of example only and any other means known to the art may be employed or devised depending in part upon the structure of frame 16.

Figure 4:
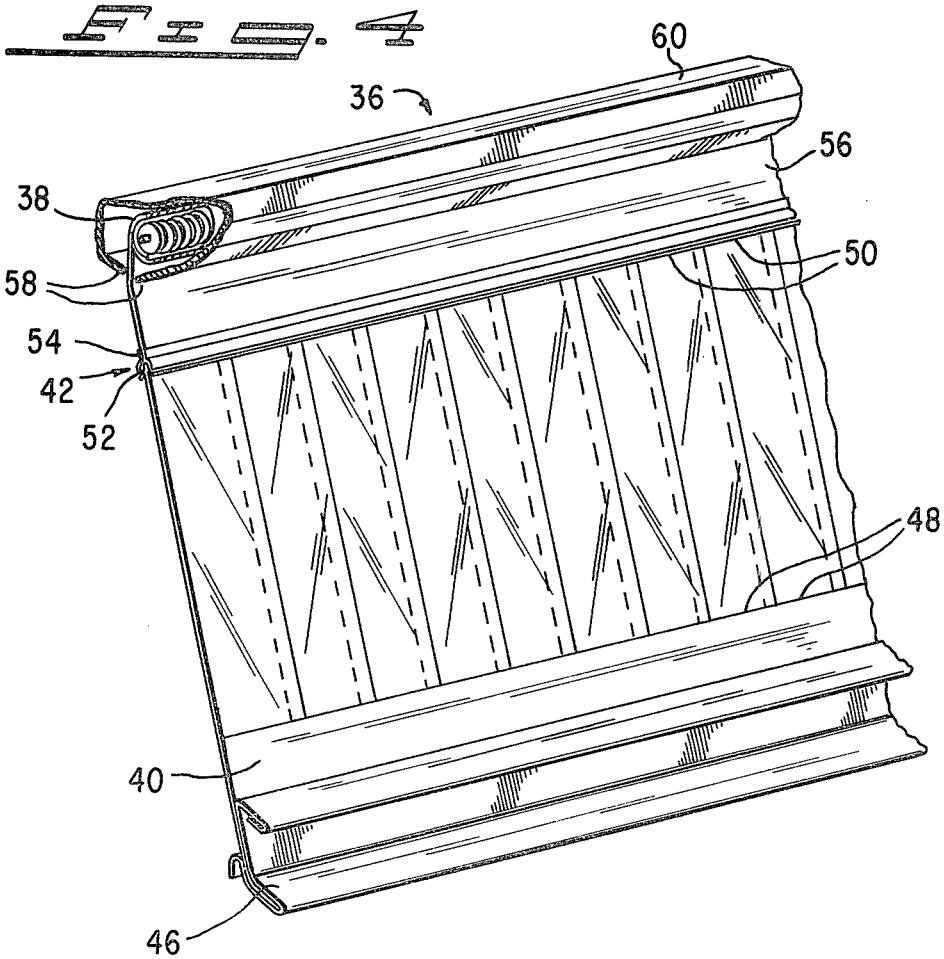
FIG. 4 shows another embodiment of the present invention wherein tension on the plurality of panels is maintained by a spring-loaded roller.

FIG. 4 illustrates another embodiment of the present invention wherein array 14 of panels 18 are disposed across an aperture in combination with a tensioning device 36, such as a spring tensioned roller 38. In the embodiment illustrated in FIG. 4 panels 18 are overlapping in the manner as described in regard to the embodiment of FIGS. 2 and 3 but terminate or are coupled at one end to an end panel 40 and at the other end to a fixture 42. End panel 40 may likewise be coupled to a receiving fixture 46 which in turn is attached to refrigerated display device 10. The manner of coupling end panel 40 to fixture 46 may be effected by any means well known to the art. Ends 48 of panels 18 may be coupled to end panel 40 by integral molding, adhesion, thermal bonding or by any other known means.

Ends 50 of panels 18 are illustrated in FIG. 4 as terminating in a rail or fixture 52. Rail 52 is slidily disposed or otherwise temporarily coupled to a mating rail 54. Together, rails 52 and 54 comprise coupling fixture 42. Mating rail 54 is coupled to a flexible end panel 56 which is typically of the same material as panels 18. End panel 56 in turn is coupled to roller 38 within tensioning device 36. The design and detail of tensioning device 36 is well known to the art and has been used in the window screening industry. The spring of tensioning device 36 is wound to a predetermined condition to maintain a selected amount of tension upon end panel 56. When fixture 46 is uncoupled from the refrigerated unit, the spring tension on roller 38 will tend to roll end panel 56 around roller 38 thereby pulling array 14 upward into tensioning device 36. After end panel 56 has been wrapped around roller 38, coupling fixture 42, and more particularly, rail 54 will contact lips 58 of housing 60 of tensioning device 36. The relative dimension of the opening between lips 58 and rail 54 are such that further withdrawal of end panel 56 around roller 38 is prohibited. At this point, that portion of array 14 below rail 52 is no longer under tension. The lower portion of array 14 may then be conveniently removed for replacement or repair.

The embodiment of FIG. 4 will find particular adaptation in vertical refrigerated display cases having large apertures 12 which may not be conducive for use with large sized frames 16. The embodiment of FIG. 4 is also particularly useful to maintain a selected tension on panels 18 inasmuch as end panel 56 is relatively short and the variation of tension on roller 38 is small between the fully extended and fully retracted configuration of end panel 56. Furthermore, the embodiment to FIG. 4 will automatically compensate for stretching and fatigue which may occur over time and with usage of array 14 to maintain sealing or closure of edges 20 by spring tension.

FIG. 5 shows yet another embodiment of the present invention wherein panels 18 are arranged and configured in an overlapping relationship in a louvered type array to form a substantially flat shield. The array includes a plurality of resilient panels each having a fixture at each end of each panel to permit independent rotation of each end of the panel and to maintain a predetermined tension on each panel. As shown in FIG. 5 a means for tensioning and disposing panels 18 across aperture 12 may be comprised of a rotatable fixture 62. Panels 18 may extend on each side outwardly from fixture 62, thereby establishing an overlapping relationship with the adjacent panel. In addition to the inherent resiliency and twisting of panels 18, rotatable fixture 62 will increase the degree and ease of access through array 14 by permitting end segments 22, held by rotatable fixture 62, to rotate. As described below, fixture 62 is designed to assume a temporarily locked position wherein each of panels 18 will be held in alignment to the adjacent panels in an overlapping or abutting relationship to form the thermal barrier desired.

Figure 7:
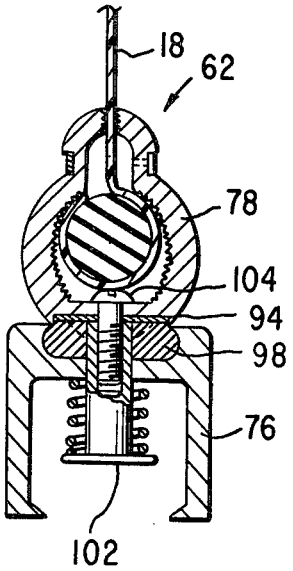
FIG. 7 is a cross section taken through section 7—7 of FIG. 6.

The operation and structure of fixture 62 can be better understood by viewing FIGS. 6 and 7. In FIG. 6 one embodiment of fixture 62 is shown in exploded perspective view. Fixture 62 is comprised of a rotatable holder 64 coupled to edge segment 22 of one of panels 18 and a receiving fixture 70. Holder 64 has a center pivot hole 66 and at least one protrusion 68 extending from holder 64. Protrusion 68 is off-set from pivot hole 66. Receiving fixture 70 is also provided with a pivot hole 66. Receiving fixture 70 has at least one indentation 72 for receiving protrusion 68. Rotatable fixture 64 also includes a spring-loaded pivot pin 74 which is disposed in pivot hole 66 in receiving fixture 70. Spring loaded-pivot pin 74 tends to urge protrusion 68 into indentation 72 thereby temporarily locking rotatable fixture 64 in a selected position. Fixture 64 rotates freely when in a configuration other than the temporarily locked position by applying torsional force to panel 18 which tends to return it to the selected or temporarily locked position. The force of the user's hands and arms against edges 20 of panels 18 is sufficient to rotate fixture 64 from the temporarily locked position to a free-swinging position. Similarly, after withdrawal of the hands and arms of the user fixture 64 will rotate back to the locked position, thereby returning array 14 of panels 18 to a substantially flat and sealed array.

Holder 64 in the particular embodiment illustrated in FIG. 6 is shown as being comprised of a clip 78 having an internal chamber 80 and a neck 82. Both chamber 80 and neck 82 are provided with a plurality of internal longitudinal indentations or ridges which form jaws which helped to grasp and secure the material of panel 18 when it is inserted into clip 78. The material of panel 18 may be wound about a cylinder with a tabbed or keyed end for use with an appropriate tool. When the desired amount of material has been withdrawn within clip 78 and the tension adjusted on panel 18, a clip retainer spring 84 may be disposed in groove 86 between neck 82 and chamber 80 of clip 78. Retainer spring 84 extends around the ends of clip 78 to the opposite groove 86 and has a nipple 88 which is urged by the resiliency of retainer spring 84 into a locking hole 90 provided in groove 86. Dimension 92 of retainer spring 84 is chosen such that when locked into hole 90, retainer spring 84 will squeeze neck 82 of clip 78 thereby causing the jaws of neck 82 and chamber 80 to bite into the material of panel 18.

A wing member 94 is shown in FIG. 6 as mating in a recess 96 provided in the bottom of clip 78. Indentation 72, which is the female counterpart of protrusion 68, is formed in a nest member 98. Nest member 98 mates in a correspondingly shaped recess 100 formed in the upper portion of track 76 in such a manner that travel along track 76 is permitted. Indentation 72, in the embodiment of FIG. 6, is shown as the double lobed, symmetric bow tie shape corresponding to protrusion 68 of wing member 94. In the illustrated embodiment, wing member 94 is provided with a double lobed protrusion 68 which is shaped in the form of a bow tie, with its center symmetrically disposed about pivot hole 66. Many other shapes for protrusion 68 may be used without departing from the spirit and scope of the present invention. For example, each lobe may be in the shape of a split, truncated tear. That portion of the tear shape nearest pivot hole 66 has sufficient thickness or extension from the plane of wing member 94 to prevent its displacement from indentation 72 in nest member 98. In other words, spring-loaded pivot pin 74 will be completely compressed before protrusion 68 can be rotated and completely displaced from indentation 72. This will prevent the complete displacement of protrusion 68 from indentation 72 when the user's hand in contact with panel 18, causes wing member 94 to rotate with respect to nest member 98. Also as a result, the spring tension exerted on protrusion 68 from spring-loaded pin 74 will tend to urge protrusion 68 back into a fully mating position within indentation 72.

As shown in cross section in FIG. 7, spring-loaded post 74 is disposed through pivot hole 66 and clip 78, wing member 94, nest member 98 and track 76. As shown in FIG. 7 spring-loaded post 74 includes two mating members, screw 104 and post 102. An access hole 83 is provided at the appropriate point in neck 82 of clip 78 to permit a tool to be inserted therethrough for the purpose of tightening screw 104. The materials of holder 64 and receiving fixture 70 may be chosen according to well known principles to optimize the application according to temperature, usage and durability. For example, wing member 94 and nest member 98 may be composed of selflubricating Teflon to avoid problems of friction, corrosion, and durability which may otherwise occur if soft metal parts were employed. However, it must be understood that the particular embodiment of FIGS. 6 and 7 are shown only for the purposes of example, and other forms of fixture 62 may be employed within the scope and spirit of the present invention, such as using an integrally molded holder 64 and receiving fixture 70.

Figure 8:
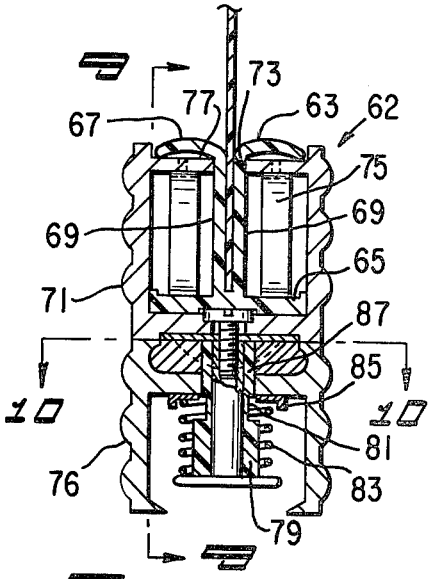
FIG. 8 is a cross section of another embodiment of a device which may be used to rotatably attach the panels to a track.

FIG. 8 is a cross sectional illustration of another embodiment of fixture 62. Embodiment of FIG. 8 differs from that of FIGS. 6 and 7 in that panel 18 is coupled to a cuff 63. Cuff 63 may be an integral molded piece having lower flanges 65 and upper flanges 67. Panel 18 is inserted into the space between sides 69 of cuff 63, may extend laterally beyond the edges of sides 69 and may be bonded, fixed or coupled to cuff 63 by any means well known to the art, such as, adhesive bonds, thermal bonding, or mechanical riveting. Cuff 63 is disposed in a clip 71 having a slot 73 through which sides 69 extend. A cuff spring 75 is disposed within clip 71 and provides a compressive spring force between the points of contact between spring 75 and lower flanges 65 of collar 63 and an upper flange 77 of clip 71. Spring 75 may be fixed or coupled to flange 77 by any well known means, such as riveting. This configuration allows cuff 63 to be extended upwardly in clip 71 by tension exerted upon panel 18. Spring 75 will urge cuff 63 downwardly into clip 71 thereby maintaining a predetermined amount of tension on panel 18. The opposite end segment 22 of panel 18 is provided with a similar apparatus and the tension exerted upon panel 18 tends to keep both opposing end segments 22 aligned, one with the other.

Clip 71 is also provided with a wing member 94 and nest member 98 of the type previously described. The fixture is coupled to track 76 by a pivot pin 74 which includes a screw 104 through clip 71 and post 102. In addition, a post sleeve 79 is disposed about post 102. Post sleeve 79 is provided with a reduced neck portion 81 described in greater detail below. Pivot pin 74 is spring loaded as described above by a coil spring 83, but also includes a washer or post spring saucer 85 disposed between spring 83 and lower surface of track 76 which saucer 58 allows post 102 to be slidingly translated along the bottom of track 76.

Figure 10:
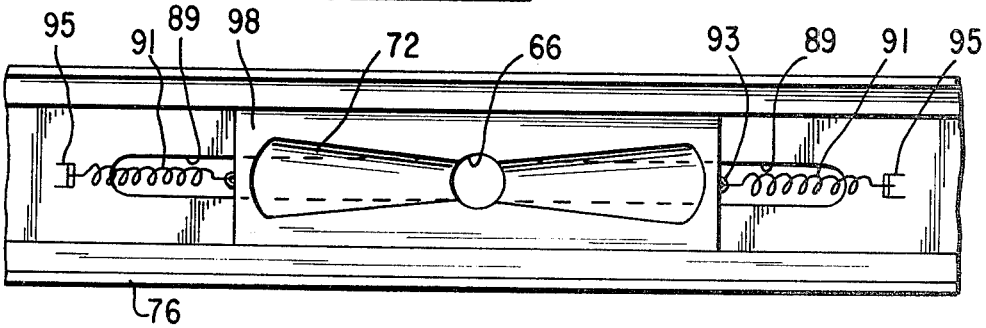
FIG. 10 is a plan view of the embodiment of FIG. 8 taken through section 10—10.

FIG. 10 illustrates in plan view, a nest member 98 disposed in recess 100 of track 76. Shown partially in phantom outline below and extending to each side of nest member 98 is a slotted raceway 89. Raceway 89 is symmetric about pivot hole 66 which is formed in the middle of raceway 89. A spring 91 is coupled between a hook or similar means at one end of nest member 98 and a punched-out tab 95 or similar means in track 76. The opposing end of nest number 98 is provided with a similar spring. When in the equilibrium position, the opposing springs center nest member 98 about pivot hole 66 in slotted raceway 89.

Figure 9:
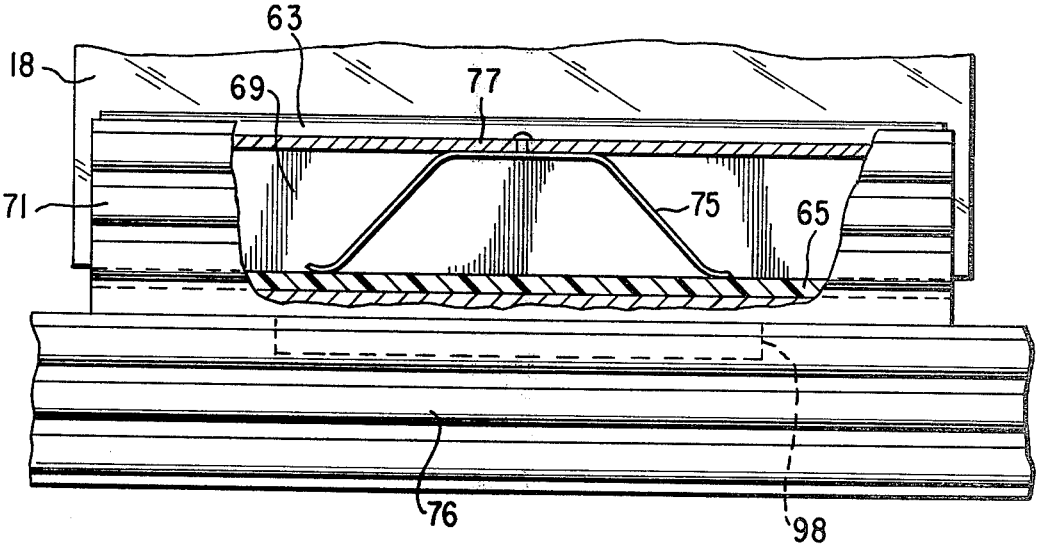
FIG. 9 is a cross section of the embodiment of FIG. 8 taken through section 9—9.

As best illustrated in FIG. 8, post sleeve 79 is in a first position when wing member 94 is in a configuration in which it fully mates with nest member 98. In this first position, post sleeve 79 has an upper portion 87 extending through pivot hole 66. The diameter of upper portion 87 is chosen such that sufficient clearance is provided for free rotation in pivot hole 66 but any movement along slotted raceway 89 is prohibited. When wing member 94 is rotated with respect to nest member 98, spring 83 will be compressed as wing member 94 rides upward and outward from the fully mating position within nest member 98. This will pull post 102 upwardly through pivot hole 66 together with post sleeve 79. After a predetermined degree of rotation, post sleeve 79 will have been drawn far enough upward to place neck portion 81 in pivot hole 66. The outer diameter of neck portion 81 is such that post sleeve 81 may freely slide along slotted raceway 89. Sufficient clearance is provided between nest member 98 and recess 100 to permit free displacement of nest member 98 when in this second position. Springs 91 will tend to urge nest member 98 back to the equilibrium position wherein post sleeve 81 is aligned with pivot hole 66. Thus, after a predetermined degree of rotation has occurred, the fixture of FIGS. 8, 9 and 10 may also be translated along slotted raceway 89 in either direction to permit further opening between panels 18. This embodiment, then, has a four-fold action. Firstly, a natural and inherent resiliency of panels 18 permit a certain degree of stretching, twisting and bending to facilitate access of a user's hand and arms between adjacent panels. Secondly, spring loaded cuff 63 will provide additional resiliency to panel 18 to further facilitate access through the panel separations. Thirdly, wing member 94 and nest member 98 in conjunction with each of the other elements of the fixture will permit rotation, as described above, to allow end segments 22 of panels 18 to be rotated to even further facilitate access through the panel array. Finally, the combination of each of the above described elements with post sleeve 81 and slotted raceway 89 permits end segments 22 of each panel to displaced in either direction to maximize the separation between panels and to allow free access without substantial inhibition. The embodiment of FIGS. 8, 9 and 10, after use, will resume their equilibrium position thereby restoring array 14 of panels 18 to a substantially flat, sealing and/or overlapping relationship to form a thermal barrier across aperture 12.

Although the present invention has been described in connection with the particular embodiments of FIGS. 1 through 10, it is to be understood that many other alterations and modification may be made by those having ordinary skill in the art without departing from the spirit and scope of the present invention. What has been described is an apparatus for reducing the electrical consumption primarily but not limited to supermarket refrigerated displays. It is also expected that the present invention will extend the life of refrigeration equipment, such as motors, generators and compressors as well as decreasing maintenance required on the same. Refrigerated units, incorporating the present invention by design, may also be built with smaller refrigeration capacities and therefore may be built in a more economical manner. In addition, advantages are obtained with respect to space airconditioning and heating in markets employing a large number of open display refrigerated devices. It will no longer be necessary to heat the market's air space due to the large heat sinks formed by the open refrigerated display cases. In addition, with the more uniformly maintained temperature within the refrigerated devices, which the present invention will allow, it is also expected that the shelf-life of refrigerated food stuffs will be extended. The degree of consumer comfort will also be increased in the proximity of a large number of refrigerated display devices thereby permitting the consumer to view the merchandise without subjecting himself to a locally cold environment.

We claim:

1. An apparatus for forming a shield across an aperture wherein a temperature gradient is maintained across said aperture while permitting access therethrough, comprising:

a plurality of substantially transparent and resilient panels, each one of said plurality of panels being adjacent to at least one other one of said plurality of panels each one of said plurality of panels assuming an overlapping relationship with at least one other one of said plurality of panels;

means for disposing said plurality of panels across said aperture and tensioning each one of said panels across said aperture said means including at one edge of said aperture a rotatable roller having a torque imparted to said roller by a spring, said roller being coupled to a flexible member, said flexible member being rolled and retractable on one end portion onto said roller and at an opposing end portion said flexible member is coupled to a rigid member which in turn is coupled to one end of each of said plurality of panels for maintaining tension on said plurality of panels;

means for affixing each opposing end of said plurality of panels along one edge of said aperture whereby the parting of an adjacent pair of said panels is operable to draw said rigid member across at least a portion of said aperture toward said means for affixing;

said means for affixing includes rotating means for permitting rotation of at least one edge segment of each of said plurality of panels about the longitudinal centerline of each panel while maintaining tension on each one of said plurality of panels;

said rotating means comprising a freely rotatable holder coupled to an edge segment of one of said panels said holder having a pivot hole and having at least one protrusion extending from said holder, said protrusion having at least a portion offset from said pivot hole;

a receiving fixture having a pivot hole and at least one indentation said indentation for mating and contacting said protrusion on said holder; and a spring-loaded pivot pin disposed in said pivot hole in said fixture and holder for urging said protrusion into said indentation to return said protrusion and indentation to a configuration of substantially full contact, said contact and mating between said offset portion of said protrusion with said indentation generating a restoring torque whereby said holder and fixture are urged into a realigned configuration;

whereby a thermal barrier is formed across said aperture without prohibiting substantially free movement therethrough.

2. The apparatus and holder of claim 1 wherein said protrusion is a symmetric, double lobed surface centered about said pivot hole.

3. The apparatus and holder of claim 2 wherein said symmetric, double lobed surface is a bow tie shaped protrusion.

4. The apparatus and holder of claim 2 wherein:

said holder includes a clip for holding one edge segment of one panel and a wing member coupled to said clip, said protrusion being formed on said wing member; and said fixture includes a nest member wherein said indentation is formed and a track, said nest member coupled to said track.

5. the apparatus of claim 1 wherein said receiving fixture includes a track having a slotted raceway defined therein and contiguous with said pivot hole to permit said pivot pin to be selectively displaced along said slotted raceway.

6. the apparatus of claim 1 wherein said holder includes a clip, a cuff movably disposed at least partially within said clip, and means for resiliently urging said cuff into a fully retracted position within said clip, said cuff being coupled to an end segment of one of said plurality of panels.

7. In an apparatus for disposing a plurality of substantially transparent and resilient panels across an aperture whereby a temperature gradient is maintained across said aperture while permitting access therethrough, each one of said plurality of panels being adjacent to at least one other one of said plurality of panels and each one of said plurality of panels further assuming an overlapping relationship with at least one of said plurality of panels, said apparatus comprising a spring means for maintaining tension on said plurality of panels, a rigid member resiliently coupled to said spring means and to one end of each of said plurality of panels, and a rotatable fixture means for rotatably affixing each opposing end of said plurality of panels along one edge of said aperture, said rotatable fixture means comprising a holder having a pivot hole and at least one protrusion offset from said pivot hole and comprising a receiving fixture having a pivot hole and at least one indentation for mating with and contacting said protrusion on said holder and further comprising a spring-loaded pivot pin disposed in said pivot hole in said receiving fixture and holder for generating a restoring torque whereby said holer and receiving fixture are urged into a realigned configuration, an improved holder comprising:

a clip having an internal chamber, a cylinder disposed within said chamber, and a neck;

said chamber and neck having a plurality of internal longitudinal ridges for grasping and securing said opposing end of one of said plurality of panels between said cylinder and said ridges of said chamber and between said ridges on said neck.

8. The apparatus of claim 7 wherein the improved holder comprises:

a clip member, a cuff member and a spring member for urging said cuff member downwardly into said clip member;

said clip member being generally rectangular in cross-section and tubular in construction, one side of which is provided with a slot extending the length of said clip member;

said cuff member comprising a generally U-shaped member provided with two flanges each one of which extends laterally outward from a respective one side of the open end of the U and a third flange which extends laterally outward on each side of the joined end of the U-shaped cuff member;

said cuff member being inserted into said clip member such that the sides of said cuff lie within said slot, the flanges at the open end of said cuff lying outside said generally rectangular clip and the flange at said joined end of said cuff being urged toward the side of said clip oposite said slot by said spring extending from adjacent said slot on the interior of said clip member to the upper surface of said flange at the joined end of said cuff member; and said opposing end of said panel being coupled to said cuff between the sides of the U-shaped cuff member.

9. An apparatus for temporarily holding a panel in a predetermined position comprising:

a freely rotatable holder coupled to an edge segment of said panel, said holder having a pivot hole and having at least one protrusion extended from said holder, said protrusion being offset from said pivot hole;

a receiving fixture having a pivot hole and at least one indentation, said indentation for mating and contacting said protrustion of said holder, said receiving fixture further comprising a track having a slotted raceway defined therein and contiguous with said pivot hole to permit said pivot pin to be selectively displaced along said slotted raceway whereby said receiving fixture and said freely rotatable holder and the panel coupled thereto are also similarly displaced thereby facilitating subsequent lateral movement of said panel, said track including means for resiliently urging said pivot pin from said slotted raceway to said pivot hole; and a spring loaded pivot pin disposed in said pivot hole in said fixture and holder for urging said protrusion into said indentation to return said protrusion and indentation to a configuration of substantially full contact, said contact and mating between said offset portion of said protrusion with said indentation generating a restoring torque whereby said holder and fixture are urged back into an aligned configuration.

* * * * *